US011181112B2

(12) United States Patent
Zielberg et al.

(10) Patent No.: US 11,181,112 B2
(45) Date of Patent: Nov. 23, 2021

(54) CONTROL ARRANGEMENT FOR A MECHANICALLY CONTROLLABLE COOLANT PUMP OF AN INTERNAL COMBUSTION ENGINE

(71) Applicant: PIERBURG GMBH, Neuss (DE)

(72) Inventors: Stephan Zielberg, Bochum (DE); Michael-Thomas Benra, Castrop-Rauxel (DE); Michael Sanders, Kaarst (DE); Stefan Rothgang, Rheinberg (DE); Andreas Burger, Krefeld (DE); Sven Nigrin, Duesseldorf (DE)

(73) Assignee: PIERBURG GMBH, Neuss (DE)

( * ) Notice: Subject to any disclaimer, the term of this patent is extended or adjusted under 35 U.S.C. 154(b) by 368 days.

(21) Appl. No.: 15/772,815

(22) PCT Filed: Oct. 19, 2016

(86) PCT No.: PCT/EP2016/075072
§ 371 (c)(1),
(2) Date: May 2, 2018

(87) PCT Pub. No.: WO2017/076644
PCT Pub. Date: May 11, 2017

(65) Prior Publication Data

US 2018/0320694 A1 Nov. 8, 2018

(30) Foreign Application Priority Data

Nov. 6, 2015 (DE) ..... 10 2015 119 098.2

(51) Int. Cl.
*F04D 15/00* (2006.01)
*F01P 5/10* (2006.01)
*F04D 13/12* (2006.01)

(52) U.S. Cl.
CPC ..... *F04D 15/0038* (2013.01); *F01P 5/10* (2013.01); *F04D 13/12* (2013.01); *F01P 2005/105* (2013.01); *F05D 2270/64* (2013.01)

(58) Field of Classification Search
CPC ..... F04D 15/0038; F04D 13/12; F01P 5/10; F01P 2005/105; F01P 7/165; F05D 2270/64
See application file for complete search history.

(56) References Cited

U.S. PATENT DOCUMENTS 916,427 A * 3/1909 Fee ..... F04D 27/002 415/26
1,518,274 A * 12/1924 Rivano ..... F03B 15/12 415/43

(Continued)

FOREIGN PATENT DOCUMENTS

CN 203516133 U 4/2014
DE 41 42 120 A1 6/1993

(Continued)

*Primary Examiner* — Kenneth Bomberg
*Assistant Examiner* — Adam W Brown
(74) *Attorney, Agent, or Firm* — Norman B. Thot

(57) ABSTRACT

A control arrangement for a coolant pump of an internal combustion engine includes a control slide which controls a throughflow cross-section of an annular gap arranged between an outlet of a coolant pump impeller and a surrounding delivery duct. A control pump adapts a hydraulic pressure generated in a flow duct. An electromagnetic valve includes a first and second valve seat, a first, second and third flow connection, a closing member and an armature. The first flow connection is fluidically connected to an outlet of the control pump. The second flow connection is fluidically connected to a first pressure chamber of the control slide. The third flow connection is fluidically connected to an inlet of the coolant pump. The first valve seat is arranged between the first flow connection and the second flow (Continued)

connection. The second valve seat is arranged between the second flow connection and the third flow connection.

10 Claims, 3 Drawing Sheets

(56) References Cited

U.S. PATENT DOCUMENTS 3,032,259 A * 5/1962 Jassniker ..... F01D 17/143 415/148
3,128,822 A * 4/1964 Tyler ..... F23K 5/02 239/124
3,309,995 A * 3/1967 Tyler ..... F04D 13/12 417/203
3,356,034 A * 12/1967 Knowles ..... F04D 27/0207 415/20
3,415,271 A * 12/1968 Maasberg ..... F04B 53/102 137/512
3,426,964 A * 2/1969 Silvern ..... F01D 17/143 415/49
3,784,318 A * 1/1974 Davis ..... F04D 15/0038 415/158
3,826,586 A * 7/1974 Richards ..... F04D 15/0038 415/42
4,074,955 A * 2/1978 Nonnemacher ..... F04B 49/002 417/218
4,257,733 A * 3/1981 Bandukwalla ..... F01D 17/143 415/13
4,460,310 A * 7/1984 Plunkett ..... F01D 17/143 415/158
4,503,684 A * 3/1985 Mount ..... F04D 27/0246 415/14
4,611,969 A * 9/1986 Zinsmeyer ..... F04D 29/464 415/1
4,828,454 A * 5/1989 Morris ..... F04D 15/0038 415/131
5,281,088 A * 1/1994 Brandt ..... F04D 29/588 415/171.1
5,297,928 A * 3/1994 Imakiire ..... F04D 29/5846 415/112
5,332,367 A * 7/1994 Suzuki ..... F24V 40/00 417/286
6,810,911 B2 * 11/2004 Hirota ..... F16K 31/426 137/625.43
6,837,193 B2 * 1/2005 Kobayashi ..... F01P 7/167 123/41.02
7,252,474 B2 * 8/2007 Belokon ..... F01D 3/04 415/1
8,291,703 B2 * 10/2012 Garrett ..... F01D 17/167 415/158
8,671,893 B2 * 3/2014 Popp ..... F04D 15/0038 123/41.44
8,689,552 B2 * 4/2014 Iwata ..... F04D 29/462 415/26
9,874,226 B2 * 1/2018 Fukuyama ..... F04D 27/0253
10,508,650 B2 * 12/2019 Zielberg ..... F04D 5/002
2008/0317609 A1 12/2008 Schmidt et al.
2010/0284832 A1 11/2010 Schmidt et al.
2012/0291724 A1 11/2012 Popp et al.
2017/0370274 A1 12/2017 Hoffmann et al.

FOREIGN PATENT DOCUMENTS

DE 10 2004 054 637 B4 4/2007
DE 10 2008 026 218 B4 4/2012
DE 10 2010 044 167 A1 5/2012
DE 10 2012 207 387 A1 1/2013
DE 10 2013 011 209 B3 1/2014
DE 10 2013 111 939 B3 10/2014
DE 10 2014 009 367 B3 3/2015
DE 10 2014 110 231 B3 9/2015
JP 0755044 A 3/1995
JP 2009-520899 A 5/2009

* cited by examiner

CONTROL ARRANGEMENT FOR A MECHANICALLY CONTROLLABLE COOLANT PUMP OF AN INTERNAL COMBUSTION ENGINE

CROSS REFERENCE TO PRIOR APPLICATIONS

This application is a U.S. National Phase application under 35 U.S.C. § 371 of International Application No. PCT/EP2016/075072, filed on Oct. 19, 2016 and which claims benefit to German Patent Application No. 10 2015 119 098.2, filed on Nov. 6, 2015. The International Application was published in German on May 11, 2017 as WO 2017/076644 A1 under PCT Article 21(2).

FIELD

The present invention relates to a control arrangement for a mechanically controllable coolant pump for an internal combustion engine having an adjustable control slide via which a throughflow cross-section of an annular gap between an outlet of a coolant pump impeller and a surrounding delivery duct is controllable, a control pump via which a hydraulic pressure is adapted to be generated, a first pressure chamber of the control slide which is formed on a first axial side of the control slide, and an electromagnetic valve having two valve seats and three flow connections as well as a closing member which is connected to an armature of the electromagnetic valve and is adapted to be axially moved, wherein the first flow connection is fluidically connected to an outlet of the control pump and the second flow connection is fluidically connected to the first pressure chamber of the control slide.

BACKGROUND

Such control arrangements for coolant pumps in internal combustion engines serve for the flow rate control of the delivered coolant to prevent the internal combustion engine from overheating. These pumps are in most cases driven via a belt or a chain drive so that the coolant pump impeller is driven at the speed of the crankshaft or at a fixed ratio to the speed of the crankshaft.

In modern internal combustion engines, the delivered coolant flow rate must be matched with the coolant demand of the internal combustion engine or the motor vehicle. The cold running phase of the engine should in particular be reduced to prevent increased pollutant emissions and to reduce fuel consumption. This is realized, inter alia, by restricting or completely switching off the coolant flow during this phase.

Various arrangements for controlling coolant flow rate are known. Besides electrically driven coolant pumps, pumps are known which can be coupled to or decoupled from their drive units via couplings, in particular hydrodynamic couplings. A particularly inexpensive and simple manner of controlling the delivered coolant flow is the use of an axially movable control slide which is pushed across the coolant pump impeller so that, for reducing the coolant flow, the pump does not deliver into the surrounding delivery duct but against the closed slide.

The operation of this slide is also performed in different ways. Besides a purely electric adjustment, a hydraulic adjustment of the slides has in particular proved successful. A hydraulic displacement is in most cases carried out via an annular piston chamber or a pressure chamber of a different design which is filled with a hydraulic fluid to move the slide across the coolant pump impeller during the filling process. The slide is returned by opening the pressure chamber towards an outlet, in most cases via a 2/2-way magnetic valve, as well as via a spring action providing the force for returning the slide.

For the coolant flow required for moving the slide not to be supplied via additional delivery units, such as additional piston/cylinder units, or for other hydraulic fluids not to be compressed for operating purposes, control arrangements are known where a control pump generating the required pressure is arranged on the drive shaft of the coolant pump, which, accordingly, serves to adjust the slide. These control pumps are designed, for example, as side channel pumps or as servo pumps.

A control arrangement for a mechanically driven controllable coolant pump having a control pump generating a pressure for moving a control slide is described in DE 10 2012 207 387 A1. In this pump, via a 3/2-way valve, in a first position, a discharge side of the control pump is closed and a suction side of the pump is connected to the coolant circuit and the slide, and in a second position, the discharge side is connected to the slide and the suction side is connected to the coolant circuit. A spring is used for returning the slide which may be omitted when the pump is to be reset by the negative pressure produced at the suction connection. The first flow connection of the valve is accordingly connected to the pressure chamber, the second flow connection is connected to the outlet of the control pump, and the third flow connection is connected to the inlet of the control pump. A detailed duct and flow routing of the control arrangement is not disclosed. In modern internal combustion engines, the schematically shown flow routing is only realizable with an increased technical effort and with a larger installation space. Rapid evacuation of the piston chamber is also not possible since the evacuation takes place towards the inlet of the control pump, whereby a pressure builds up in the overall duct, which acts as a counterpressure in the piston chamber.

SUMMARY

An aspect of the present invention is to provide a control arrangement for a coolant pump of an internal combustion engine with switching times which are as short as possible so that the required coolant flow can if possible be immediately made available. An aspect of the present invention is at the same time to minimize the required installation space. A return of the slide into its position for providing a maximum flow rate of the coolant pump should if possible be allowed without using a pressure spring acting upon the control slide. A variable control of the coolant flow should also be carried out if possible.

In an embodiment, the present invention provides a control arrangement for a mechanically controllable coolant pump of an internal combustion engine. The control arrangement includes a control slide configured to be adjustable so as to control a throughflow cross-section of an annular gap which is arranged between an outlet of a coolant pump impeller and a surrounding delivery duct. The control slide comprises a first pressure chamber formed on a first axial side of the control slide. A control pump is configured to adapt a hydraulic pressure which is generated in a flow duct. The control pump comprises an outlet. An electromagnetic valve comprises a first valve seat, a second valve seat, a first flow connection, a second flow connection, a third flow connection, a closing member and an armature. The closing member is connected to the armature so that each are movable axially. The first flow connection is fluidically connected to the outlet of the control pump. The second flow connection is fluidically connected to the first pressure chamber of the control slide. The third flow connection is fluidically connected to an inlet of the coolant pump. The first valve seat is arranged between the first flow connection and the second flow connection. The second valve seat is arranged between the second flow connection and the third flow connection.

BRIEF DESCRIPTION OF THE DRAWINGS

The present invention is described in greater detail below on the basis of embodiments and of the drawings in which.

DETAILED DESCRIPTION

Figure 1:
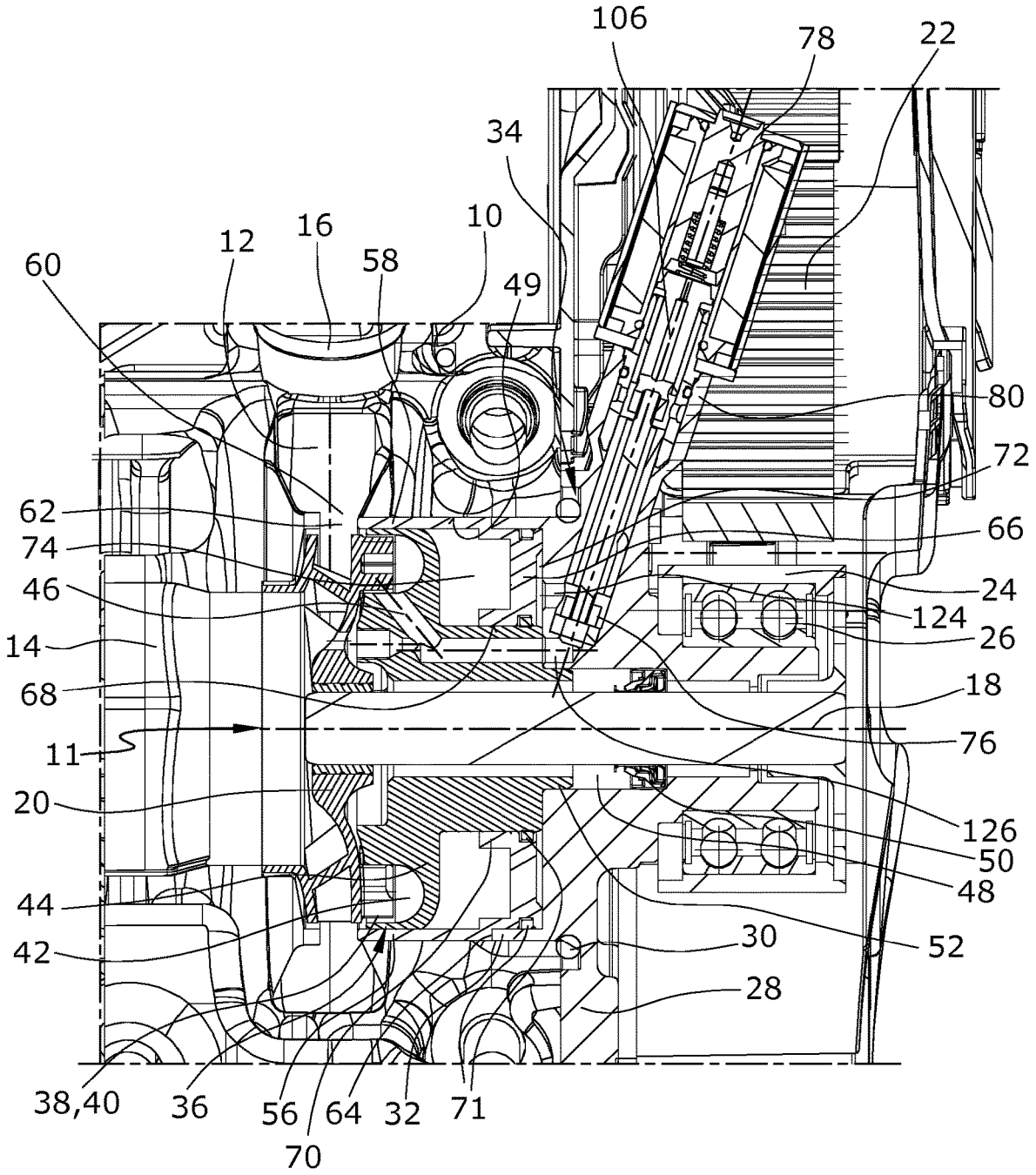
FIG. 1 shows a cross-sectional side view of a coolant pump having a control arrangement according to the present invention.
Figure 2:
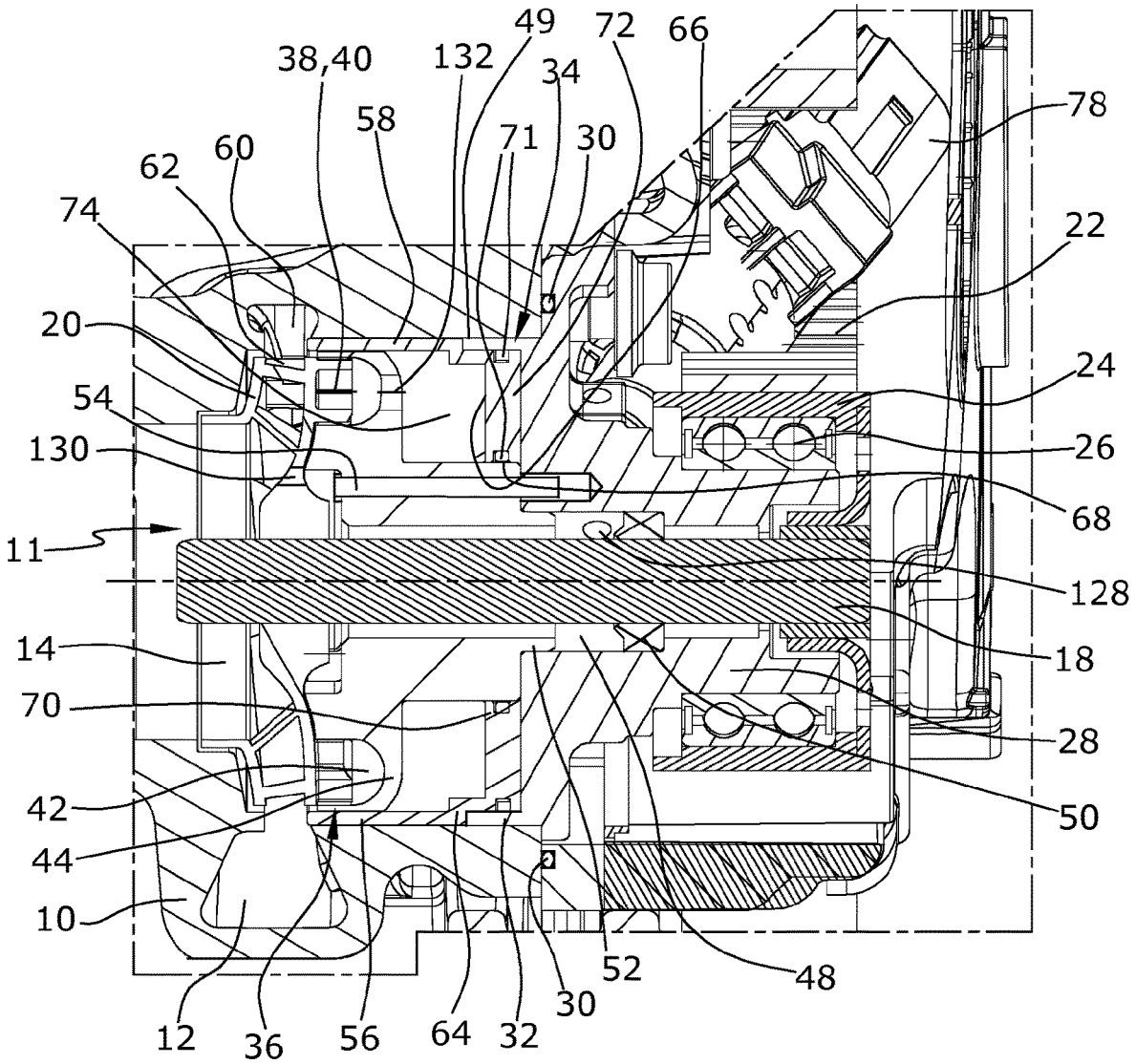
FIG. 2 shows a cross-sectional side view of the coolant pump of FIG. 1 rotated with respect to FIG. 1.

Due to the fact that the third flow connection is fluidically connected to an inlet of the coolant pump, whereby the first valve seat is formed between the first flow connection and the second flow connection and the second valve seat is formed between the second flow connection and the third flow connection, a connection between the pressure chamber and the inlet of the coolant pump can either be created, whereby the coolant present therein can be rapidly extracted and the pressure in the pressure chamber can be rapidly decreased, or a connection from the outlet of the control pump to the pressure chamber can be created, whereby a pressure is applied to the pressure chamber and thus the control slide. A short-term adjustment of the control slide by switching the electromagnetic valve is thus made possible.

In an embodiment of the present invention, the electromagnetic valve can, for example, comprise a flow housing in which the closing member is adapted to be moved between the two valve seats, and an electromagnetic actuator having a core, flow-conducting elements, a winding arranged on a coil carrier and the axially movable armature. The closing member thus only need to cover short distances. The switching times are thereby reduced.

In an embodiment of the present invention, at least the flow housing of the electromagnetic valve can, for example, be arranged in an accommodation opening of a housing part of the coolant pump. The electromagnetic valve is accordingly to be arranged in the immediate vicinity of the control pump, whereby the length of the lines is reduced, which also results in a reduction of the switching times of the control arrangement. A small installation space is also required and assembly is facilitated since the overall control arrangement can be preassembled with the coolant pump and inserted into the outer housing.

A first duct is advantageously formed in the housing part via which the first pressure chamber is connected to the second flow connection. Additional lines are not required. Extremely short connections for realizing more rapid switching times are instead provided.

It is also advantageous when, in the housing part, a second duct is formed which is connected to the first flow connection of the electromagnetic valve and continues in the control pump housing up to the outlet of the control pump. No additional lines thus need to be installed for the connection between the pressure connection and the pressure chamber since these lines are fully integrated in the housing. These connections accordingly have a short running length.

In an embodiment of the present invention, in the housing part, a third duct can, for example, be formed which is connected to the third flow connection of the electromagnetic valve and extends into a radially inner through-going opening of the housing part which continues inside the control pump housing and extends through the drive shaft of the coolant pump, wherein, in the coolant pump impeller, an axial bore is formed which extends to the inlet of the coolant pump. The connection to the inlet of the coolant pump is thus provided in a simple manner by only one additional duct in the housing part, which is in particular configured as a bore, and at least one bore in the coolant pump impeller. This connection is also realized over very short distances without requiring the installation of any additional lines.

In an embodiment of the present invention, a duct is formed in the control pump housing in the area of an inlet of the control pump via which a second pressure chamber is fluidically connected to the flow duct of the control pump so that the coolant pump is designed without any additional means permanently applying a force, such as pressure springs and the like. The required actuating forces are thus reduced so that a switching of the control arrangement is again provided with very short response times.

In an embodiment of the present invention, the closing member of the electromagnetic valve can, for example, be arranged on a valve rod, wherein a closing surface at a first axial end of the closing member is associated with the first valve seat and a closing surface at the opposite axial end is associated with the second valve seat. A tight and almost leakage-free closing of the respective throughflow cross-section is realized since the closing member axially rests upon the respective valve seat. A closing member loaded on both sides is only required therefor, whereby the setup of the electromagnetic valve is also facilitated.

The electromagnetic valve can, for example, be configured as a proportional valve. This allows for a permanent control of the valve opening so that the control slide can also be moved into intermediate positions and thus the coolant flow can be completely controlled. These valves have a long service life since the valve body does not hit on the valve seat very often.

In an embodiment of the present invention, the electromagnetic valve can, for example, be driven in a variably clocked manner. A servo valve driven in this manner is more expensive to manufacture, but allows for an even more precise control of the desired opening cross-sections so that an even more precise control of the position of the control slide is provided.

A control arrangement for a coolant pump of an internal combustion engine is thus provided which provides a very precise and very rapid control of the coolant flow. Only a very small installation space is required, and the assembly time is considerably reduced. A purely hydraulic control of the position of the control slide with extremely short response times is in particular provided.

An exemplary embodiment of a coolant pump according to the present invention for an internal combustion engine is illustrated in the drawings and is described below.

The illustrated coolant pump 11 is composed of an outer housing 10 in which a spiral delivery duct 12 is formed into which a coolant is sucked via an axial inlet 14 that is also formed in the outer housing 10, which coolant is delivered via the delivery duct 12 to a tangential pump outlet 16 formed in the outer housing 10 and into a cooling circuit of the internal combustion engine.

For this purpose, radially inside the delivery duct 12, a coolant pump impeller 20 is fastened to a drive shaft 18, which coolant pump impeller 20 is configured as a radial pump wheel, the rotation of which effects the delivery of the coolant in the delivery duct 12. The coolant pump impeller 20 is driven via a belt 22 which engages with a belt pulley 24 that is fastened to the axial end of the drive shaft 18 opposite to the coolant pump impeller 20. The belt pulley 24 is supported via a two-row ball bearing 26 which is pressed to a stationary housing part 28 fastened to the outer housing 10 using a seal 30 as an intermediate layer. For pre-fixing purposes, the stationary housing part 28 comprises an annular projection 32 which is fitted into a corresponding accommodation portion of the outer housing 10.

For controlling the coolant pump 11, a control arrangement 34 of the cooling pump 11 is provided on the axial side of the coolant pump impeller 20 opposite to the axial inlet 14. The control arrangement includes a control pump 36 having a control pump impeller 38 which is integrally formed with the coolant pump impeller 20 and which is accordingly rotated together with the coolant pump impeller 20. This control pump impeller 38 comprises blades 40 which are arranged axially opposite to a flow duct 42 which is configured as a side channel formed in a control pump housing 44. In the control pump housing 44 an inlet (not shown in the drawings) and an outlet 46 are formed via which the coolant can flow in and/or can flow out at an increased pressure.

Similar to the stationary housing part 28, the control pump housing 44 comprises an inner axial through-going opening 48 through which the drive shaft 18 extends, with a seal 50 as an intermediate layer, in the area of the stationary housing part 28, and is fastened to the stationary housing part 28. An annular projection 52 facing the stationary housing part 28 is formed therefor at the control pump housing 44, which annular projection 52 projects into a corresponding accommodation opening 49 of the stationary housing part 28, whereby a pre-fixing is performed. The control pump housing 44 is subsequently fastened by screws 54 which extend through the control pump housing 44 into corresponding threaded bores of the stationary housing part 28.

The control of the delivered coolant flow of the coolant pump 11 is effected via a control slide 56 whose cylindrical circumferential wall 58 can be pushed across the coolant pump impeller 20 so that a free cross-section of an annular gap 60 between an outlet 62 of the coolant pump impeller 20 and the delivery duct 12 can be controlled. The movement of the control slide 56 is restricted by the end of the annular gap 60 by the annular projection 32 upon whose axial end a shoulder 64 of the cylindrical circumferential wall 58 rests in the position of the control slide 56 in which the annular gap 60 is fully opened.

In addition to the cylindrical circumferential wall 58, the control slide 56 comprises a bottom 66 from whose outer circumference the cylindrical circumferential wall 58 axially extends between the control pump housing 44 and the outer housing 10 towards the axially adjoining annular gap 60. In the radially inner area, the bottom 66 comprises an opening 68 which is delimited by a hollow cylindrical portion 70 via which the control slide 56 is supported on the control pump housing 44. A radial groove is formed at each of the outer and the inner circumference of the bottom 66, in each of which a piston ring 71 is arranged, via which piston ring 71 the two axially opposite sides of the control slide 56 are sealed towards each other.

On the side of the control slide 56 facing away from the coolant pump impeller 20, a first pressure chamber 72 is located which is axially delimited by the stationary housing part 28 and the bottom 66 of the control slide 56 and which is delimited radially outwards by the outer housing 10 and/or the annular projection 32 of the stationary housing part 28 and which is delimited radially inwards by the control pump housing 44. On the side of the bottom 66 facing the coolant pump impeller 20, a second pressure chamber 74 is formed which is axially delimited by the bottom 66 and the control pump housing 44, which is delimited radially outwards by the cylindrical circumferential wall 58 of the control slide 56 and which is delimited radially inwards by the control pump housing 44. The cylindrical circumferential wall 58 of the control slide 56 is pushed into the annular gap 60 or is removed from the annular gap 60 depending on the pressure difference prevailing at the bottom 66 of the control slide 56 in the two pressure chambers 72, 74.

The pressure difference required for this purpose is generated by the control pump 36, wherein the corresponding pressure, depending on the position of a closing member 76 of a 3/2-way electromagnetic valve 78, is supplied to the respective pressure chamber 72, 74. For this purpose, an accommodation opening 80 for the electromagnetic valve 78 is formed in the stationary housing part 28, in which accommodation opening 80 a flow housing 82 of the electromagnetic valve 78 is accommodated.

Figure 3:
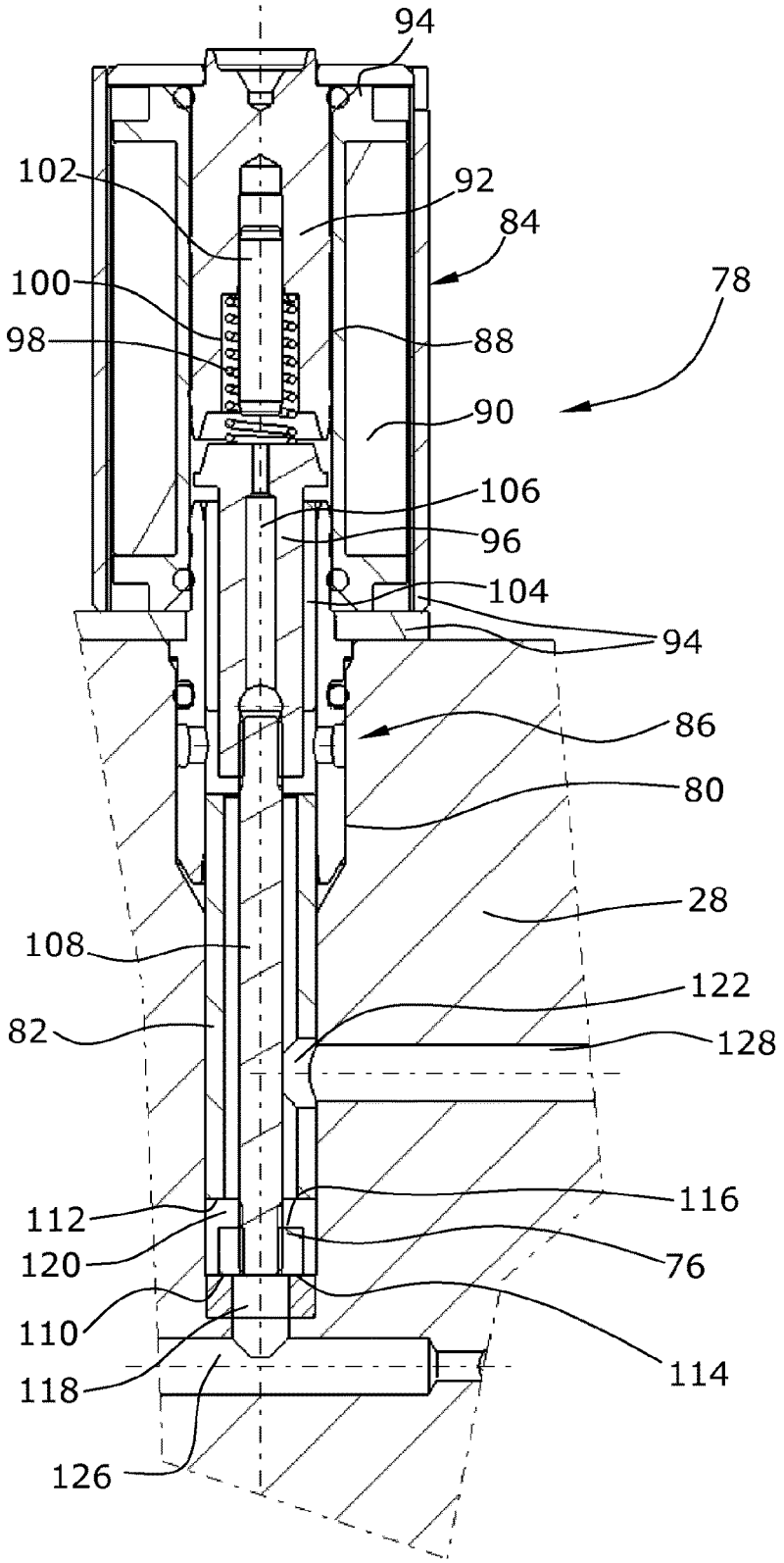
FIG. 3 shows a cross-sectional diagram of a 3/2-way electromagnetic valve of a control arrangement according to the present invention enlarged as compared with FIG. 1.

The electromagnetic valve 78 is illustrated in FIG. 3. The electromagnetic valve 78 comprises an electromagnetic actuator 84 as well as a valve unit 86. The actuator 84 comprises a winding 90 arranged on a coil carrier 88 inside which a core 92 is located and which is axially and radially surrounded by flow-conducting elements 94 of the electromagnetic circuit. When current is applied to the winding 90, an axially movable armature 96 is pulled towards the core 92. This movement is carried out against the force of a spring 98 which is arranged at the core 92 between the core 92 and the armature 96 in a recess 100 and surrounds a non-magnetizable pin 102 fastened in the core 92, which pin 102 serves as a stopper for the armature 96 so that the armature 96 does not rest upon the core 92 in its position in which it has been moved towards the core 92 since this would result in undesired adhesive forces. The armature 96, which is supported in a sliding sleeve 104 fastened in the flow housing 82, comprises a bore 106 via which the space between the armature 96 and the core 92 is connected with a space on the side opposite to the sliding sleeve 104, whereby a fluid present inside the electromagnetic valve 78 between the armature 96 and the core 92 is prevented from being compressed towards the core 92 when the armature 96 is moved and thus generating a force counteracting the movement. The fluid can instead flow off through the bore 106.

The valve unit 86 comprises the flow housing 82 as well as a valve rod 108 fastened to the end of the armature 96, at whose end the closing member 76 is fastened which cooperates with two valve seats 110, 112 arranged in the flow housing 82, wherein the valve seat 110 can also directly be formed in the stationary housing part 28 at the end of the accommodation opening 80. For this purpose, the closing member 76 comprises two closing surfaces 114, 116 formed at the two axially opposite ends, wherein the first closing surface 114 rests upon the first valve seat 110 when no current is applied to the armature 84 and the second closing surface 116 axially rests upon the second valve seat 112 when current is applied to the armature 84.

The first valve seat 110 is arranged between a first flow connection 118 of the flow housing 82 located in the stationary housing part 28 and a second flow connection 120, the second valve seat 112 is arranged between the second flow connection 120 and a third flow connection 122 so that a connection either exists between the first flow connection 118 and the second flow connection 120, or between the second flow connection 120 and the third flow connection 122. For supplying the first pressure chamber 72 with a pressurized fluid, a first duct 124 in the form of a simple bore is formed in the stationary housing part 28, which first duct 124 extends from the second flow connection 120 into the first pressure chamber 72. The first flow connection 118 ends in a second duct 126 formed in the stationary housing part 28, which second duct 126 continues in the control pump housing 44 up to the outlet 46 of the control pump 36. In the case of a fluidic connection of the first flow connection 118 with the second flow connection 120, the first pressure chamber 72 is accordingly supplied with the pressurized fluid from the flow duct 42 of the control pump 36 via the firsts duct 124 and the second duct 126, whereby the control slide 56 is pushed into its position for closing the annular gap 60. This is carried out when the second closing surface 116 of the closing member 76 rests upon the second valve seat 112, which is realized when current is applied to the actuator 84 and, accordingly, the armature 84 is in its retracted position. The control slide 56 is accordingly completely moved into the annular gap 60 so that the coolant delivery of the coolant pump 11 is stopped.

If the coolant pump 11 is to deliver a maximum coolant flow to the pump outlet 16 during operation, the annular gap 60 at the outlet 62 of the coolant pump impeller 20 is completely opened by not applying current to the actuator 84, whereby the first closing surface 114 of the closing member 76 is pressed against the first valve seat 110 by the force of the spring 98, whereby the connection of the outlet 46 of the control pump 36 to the first pressure chamber 72 is interrupted and instead a connection of the second flow connection 120 and thus the first pressure chamber 72 to the third flow connection 122 is opened, which third flow connection 122 ends in a third duct 128 that extends through the stationary housing part 28 radially inwards up to the through-going opening 48. The through-going opening 48 extends radially inside the control pump housing 44 through the overall control pump housing 44 up to directly behind the coolant pump impeller 20. The coolant pump impeller 20 comprises one or several axial bores 130 through which the coolant can flow to the inlet 14 of the coolant pump 11 so that the coolant is extracted from the first pressure chamber 72 by the coolant pump 11. Closing of the first valve seat 110 results in the control pump 36 delivering against the closed first flow connection 118. An increased pressure builds thereby up in the overall flow duct 42, which also acts in the area of the inlet of the control pump 36. However, in the control pump housing 44, in the area of this inlet, a connecting duct 132 in the form of a bore is formed from the flow duct 42 to the second pressure chamber 74 so that this increased pressure also builds up in the second pressure chamber 74. This increased pressure in the second pressure chamber 74 results in a pressure difference occurring at the bottom 66 of the control slide 56 so that the control slide 56 is moved into its position for opening the annular gap 60 and thus maximum delivery of the coolant pump 11 is provided.

In the case of failure of the power supply of the magnetic valve 78, the control slide 56 accordingly assumes the same position so that a maximum delivery of the coolant pump 11 is provided even in this emergency operating state without a return spring or any other non-hydraulic power being necessary.

An excessive increase of the pressure in the second pressure chamber 74 is avoided, inter alia, due to a leakage between the control pump housing 44 and the cylindrical circumferential wall 58 so that the coolant additionally delivered by the control pump 36 is also used for delivery into the cooling circuit.

If the engine control again requires a reduced coolant flow, as is the case, for example, during the warm-up of the internal combustion engine after a cold start, current is applied again to the magnetic valve 78 so that the pressure produced at the outlet 46 of the control pump 36 is again transferred to the first pressure chamber 72 while at the same time the pressure in the second pressure chamber 74 decreases since in the area of the inlet a reduced pressure occurs due to the intake of the coolant. The coolant present in the second pressure chamber 74 is also initially extracted. In this state, a pressure difference is accordingly again present at the bottom 66 of the control slide 56, which pressure difference results in the control slide 56 being moved into the annular gap 60 and thus the coolant flow in the cooling circuit being interrupted. In the case of an increased pressure buildup in the first pressure chamber 72, the pressure in the flow duct 42 and in the second pressure chamber 74 also increases after a while, but this does not lead to a return movement since the leakage from the second pressure chamber 74 is larger than that from the first pressure chamber 72 and, for adjustment purposes, a frictional force would additionally have to be overcome. The control slide 56 accordingly remains in the desired position without an excessive pressure increase.

A proportionally operating or a variably clocked magnetic valve 78 is used for additionally realizing a complete controllability of the delivered coolant flow, whereby it is also possible to move the valve 78 into intermediate positions so that an equilibrium of forces is attainable for each position of the control slide 56 when a proportional valve is used and, accordingly, a complete control of the throughflow cross-section of the annular gap 60 is provided. In the case of the clocked magnetic valve 78, the pressure in the first pressure chamber 72 and in the second pressure chamber 74 is determined by the time ratio of opened and closed valve. The valve 78 is accordingly oscillatingly driven via a frequency which is kept low so that, via the frequency, the temporal throughput can be varied and controlled through the valve 78. An even more precise control is thus allowed for.

The described control arrangement in particular has an extremely compact design due to the integration of the electromagnetic valve and its configuration as a 3/2-way valve, while being easy and inexpensive to manufacture and assemble. Additional lines for a hydraulic connection of the control pump to the pressure chambers of the control slide can be omitted since these chambers can be configured over very short distances as simple bores in the two inner housing parts. The purely hydraulic adjustment of the control slide is effected very rapidly with short response times. The force required for moving the control slide into the position for closing the annular gap is also reduced since the return spring is omitted so that a more rapid adjustment with smaller cross-sections is possible.

It should be appreciated that the scope of protection of the present invention is not limited to the described exemplary embodiment. Other split designs of the housing of a differently configured control pump are also conceivable. The duct routing or the delimitation of the pressure chambers can also be changed without departing from the scope of protection of the present invention. A two-piece configuration of the two pump impellers is also, for example, conceivable. Reference should also be had to the appended claims.

What is claimed is:

1. A control arrangement for a coolant pump of an internal combustion engine, the coolant pump being configured to be mechanically controllable, the control arrangement comprising:

a control slide configured to be adjustable so as to control a throughflow cross-section of an annular gap which is arranged between an outlet of a coolant pump impeller and a surrounding delivery duct, the control slide comprising a first pressure chamber formed on a first axial side of the control slide;

a control pump configured to adapt a hydraulic pressure which is generated in a flow duct, the control pump comprising an inlet, an outlet, a control pump housing, and the flow duct;

an electromagnetic valve comprising a first valve seat, a second valve seat, a first flow connection, a second flow connection, a third flow connection, a closing member and an armature, the closing member being connected to the armature so that each are movable axially, a second pressure chamber; and a connecting duct arranged in the control pump housing in an area of the inlet of the control pump, the connecting duct being configured to fluidically connect the second pressure chamber to the flow duct of the control pump, wherein, the first flow connection is fluidically connected to the outlet of the control pump, the second flow connection is fluidically connected to the first pressure chamber of the control slide, the third flow connection is fluidically connected to an inlet of the coolant pump, the first valve seat is arranged between the first flow connection and the second flow connection, and the second valve seat is arranged between the second flow connection and the third flow connection.

2. The control arrangement as recited in claim 1, wherein, the electromagnetic valve further comprises a flow housing and an electromagnetic actuator which comprises a core, flow-conducting elements, a coil carrier, a winding arranged on the coil carrier, and the armature, and the closing member is configured to be movable in the flow housing between the first valve seat and the second valve seat.

3. The control arrangement as recited in claim 2, wherein, the coolant pump comprises a housing part which comprises an accommodation opening, and at least the flow housing of the electromagnetic valve is arranged in the accommodation opening.

4. The control arrangement as recited in claim 3, wherein, the housing part further comprises a first duct arranged, and the first pressure chamber is connected to the second flow connection via the first duct.

5. The control arrangement as recited in claim 4, wherein, the control pump further comprises the control pump housing, the housing part further comprises a second duct arranged therein, and the second duct is connected to the first flow connection of the electromagnetic valve and is arranged to continue in the control pump housing to the outlet of the control pump.

6. The control arrangement as recited in claim 5, wherein, the housing part further comprises a third duct arranged therein, and further comprising:

a radially inner through-going opening arranged in the third duct, to continue inside the control pump housing, and to extend through the drive shaft of the coolant pump, wherein, the third duct is connected to the third flow connection of the electromagnetic valve and is arranged to extend into the radially inner through-going opening of the housing part, and the coolant pump impeller comprises at least one axial bore arranged therein, the at least one axial bore being arranged to extend to the inlet of the coolant pump.

7. The control arrangement as recited in claim 5, further comprising:

a valve rod, wherein, the closing member comprises a first closing surface arranged at a first axial end and a second closing surface arranged at a second axial end, the closing member of the electromagnetic valve is fastened to the valve rod, the closing surface at the first axial end of the closing member is associated with the first valve seat, and the second closing surface at the second axial end is associated with the second valve seat.

8. The control arrangement as recited in claim 1, wherein the electromagnetic valve is a proportional valve.

9. The control arrangement as recited in claim 1, wherein the electromagnetic valve is configured to be driven in a variably clocked manner.

10. A control arrangement for a coolant pump of an internal combustion engine, the coolant pump being configured to be mechanically controllable, the control arrangement comprising:

a control slide configured to be adjustable so as to control a throughflow cross-section of an annular gap which is arranged between an outlet of a coolant pump impeller and a surrounding delivery duct, the control slide comprising a first pressure chamber formed on a first axial side of the control slide;

a control pump configured to adapt a hydraulic pressure which is generated in a flow duct, the control pump comprising an inlet, an outlet, a control pump housing, and the flow duct; and an electromagnetic valve comprising a first valve seat, a second valve seat, a first flow connection, a second flow connection, a third flow connection, a closing member and an armature, the closing member being connected to the armature so that each are movable axially, a second pressure chamber; and a connecting duct arranged in the control pump housing in an area of the inlet of the control pump, the connecting duct being configured to fluidically connect the second pressure chamber to the flow duct of the control pump, wherein, the first flow connection is fluidically connected to the outlet of the control pump, the second flow connection is fluidically connected to the first pressure chamber of the control slide, the third flow connection is fluidically connected to an inlet of the coolant pump, the first valve seat is arranged between the first flow connection and the second flow connection, the second valve seat is arranged between the second flow connection and the third flow connection, and a connection between the first pressure chamber and the inlet of the coolant pump is established or a connection from the outlet of the control pump to the first pressure chamber is established.

* * * * *